United States Patent [19]

Browning

[11] 4,342,551

[45] Aug. 3, 1982

[54] IGNITION METHOD AND SYSTEM FOR INTERNAL BURNER TYPE ULTRA-HIGH VELOCITY FLAME JET APPARATUS

[75] Inventor: James A. Browning, Hanover, N.H.

[73] Assignee: Browning Engineering Corporation, Hanover, N.H.

[21] Appl. No.: 152,965

[22] Filed: May 23, 1980

[51] Int. Cl.[3] ..... F23M 3/00

[52] U.S. Cl. ..... 431/10; 431/158; 60/39.46 R

[58] Field of Search ..... 431/158, 10; 60/39.46 G, 39.46 R; 51/321, 439

[56] References Cited

U.S. PATENT DOCUMENTS

| | | | |
|---|---|---|---|
| 2,990,653 | 7/1961 | Browning | 51/439 |
| 3,015,842 | 1/1962 | Stalego | 431/158 |
| 3,045,766 | 7/1962 | Fleming, Jr. | 431/158 |
| 3,101,592 | 8/1963 | Robertson et al. | 60/39.46 G |
| 3,385,381 | 5/1968 | Calaman | 431/158 |
| 4,123,220 | 10/1978 | Bond et al. | 431/158 |

*Primary Examiner*—James C. Yeung

*Attorney, Agent, or Firm*—Sughrue, Mion, Zinn, Macpeak & Seas

[57] ABSTRACT

An elongated casing forming an air cooled combustion chamber includes a venturi type jet nozzle at one end and an ignition system spark plug at its opposite end in axial alignment with the nozzle bore. The spark plug includes a first electrode separated from a second electrode by an annular space. A gas having an oxygen content in excess of that of natural air is introduced to the annular space to improve ignition and internal burner start up. Liquid fuel flow is introduced into the region of extended spark within the combustion chamber and downstream of the ends of the first and second electrodes. Compressed air, after initial cooling of the combustion chamber wall and nozzle, enters the end of the combustion chamber housing the spark plug to create with the fuel a combustible mixture. Some of the compressed air is fed to the annular space between first and second electrodes to maintain the extended spark and improved ignition of the fuel/air mixture.

4 Claims, 2 Drawing Figures

IGNITION METHOD AND SYSTEM FOR INTERNAL BURNER TYPE ULTRA-HIGH VELOCITY FLAME JET APPARATUS

FIELD OF THE INVENTION

This invention relates to air/fuel internal burners employed in the creation of ultra-high velocity flame jets for work drilling and high-energy metalizing, and more particularly to an improved spark-ignition system particularly useful when liquid fuel is supplied to the internal burner.

BACKGROUND OF THE INVENTION

Some difficulty has been experienced when a liquid fuel such as diesel oil is provided to an internal burner type ultra-high velocity flame jet apparatus of the type set forth in my earlier U.S. Pat. No. 2,990,653 entitled "Method and Apparatus for Impacting a Stream of High Velocity Against the Surface to be Treated" issuing July 4, 1961. The apparatus of that patent takes the form of an air cooled double or triple wall cylindrical internal burner whose interior forms a combustion chamber and which is provided with a reduced diameter flame jet nozzle at one end thereof. At the opposite end, a fuel/air mixture is ignited, the combustion chamber receiving a continuous pressurized flow of air which mixes with the fuel and is ignited at that end of the chamber to materially increase the temperature of the continuous flowing stream prior to discharge and pressure reduction, at high velocity, through the nozzle bore. In the apparatus of that patent, combustion of a fuel/air mixture is effected by the incorporation of a spark plug and thus a spark ignition system within the cylindrical internal burner body, specifically with the spark plug at right angles to the flow axis of the stream passing through the combustion chamber. The spark ignition system is characterized by a spark plug in which one central electrode is surrounded by a second electrode, and wherein some of the compressed air employed in cooling the sidewall of the internal combustion chamber is permitted to flow through the annular space between the electrodes.

This spark ignition system, while reliably igniting gaseous fuel, proved unreliable when used with liquid fuels. Ignition was effected by arcing between the centrally located first electrode within an annular space about double the diameter of the first electrode arcing rod element and the second electrode surrounding the arcing rod. A spark was struck between these electrodes and elongated into a "flame" by causing a small portion of the compressed air employed in cooling the double wall internal burner to flow through the annular space between the electrodes.

It is, therefore, a primary object of the present invention to provide an improved method and apparatus for effecting ignition of an internal burner type ultra-high velocity flame jet apparatus for effectively burning a liquid fuel such as diesel oil, insuring initial ignition of the liquid fuel by the introduction of a gas having an oxygen content in excess of that of natural air, extending the spark between electrodes of the spark plug employed in the ignition process, and feeding in addition thereto a portion of the compressed air normally supplied to the combustion chamber, through an annular gap between the spark plug electrodes both during ignition and during normal extended operation of the flame jet apparatus.

It is a further object of this invention to provide an improved flame jet apparatus of this type, where the spark plug assembly is coaxially incorporated within the internal burner at the end of the combustion chamber opposite that of the flame jet nozzle, and wherein the fuel flow is introduced directly into the region of the extended spark bearing the oxygen enriched gas.

It is a further object of this invention to provide an improved internal burner type ultra-high velocity flame jet apparatus wherein an enriching flow of oxygen is supplied both to the area of extended spark between spaced electrodes of the internal burner and to the main compressed air flow stream entering the combustion chamber remote from the spark plug and provided as a flame reactant.

SUMMARY OF THE INVENTION

The present invention provides an improved method and ignition apparatus for an internal burner type ultra-high velocity flame jet apparatus and wherein compressed air, oxygen enriched air, or oxygen and fuel are supplied to the internal burner as operating reactants and wherein the ignition system comprises first and second electrodes separated by a space, means for creating a spark discharge between the electrodes, and wherein the length of the spark is extended by passing a flow of gas through said annular space. The improvement resides in supplying to the annular space at least during initial ignition of the internal burner, a gas having an oxygen content in excess of that of natural air.

Preferably, the supply of fuel is directed into the region of the extended spark to improve both initial combustion of the operating reactant and extended operation of the burner. Where the flow of fuel is in liquid form, the flow of the gas through the annular space functions to atomize the liquid fuel. The method of ignition may further comprise the division of enriching flow of oxygen into two portions: a first portion which is directed through the annular space between the electrodes and a second portion added to the main compressed air flow provided to the combustion chamber as a flame reactant.

In a preferred form, the internal burner type ultra-high velocity flame jet apparatus takes the form of a cylindrical internal burner defining a cylindrical combustion chamber with the burner including a nozzle at one end of the combustion chamber for discharging at high velocity the products of combustion and including coaxially at the opposite end of the combustion chamber a spark assembly having a central electrode coaxial with the combustion chamber, centered within a circular bore within a conductive injector piece which mounts the central electrode by suitable insulator. Compressed air is supplied to the interior of the combustion chamber by means of an annular distribution chamber within the injector piece and which opens longitudinally to the interior of the combustion chamber, adjacent the sidewall of the internal burner. Radial passages are formed within the injector piece communicating the compressed air annular distribution chamber to the annular space between the electrodes. Pure oxygen or oxygen enriched air is supplied to the radial passage means, thus feeding a gas whose oxygen content is in excess of that of natural air to the annular air distribution chamber and to the annular space between the electrodes. The internal burner injector piece further comprises at least one liquid fuel passage opening to the combustion chamber adjacent the edge of the second electrode and means for supplying a liquid hydrocarbon fuel thereto such that the passage compressed air plus the oxygen enriched gas through the annular space between electrodes facilitates atomization of the liquid fuel immediately in the area of the extended spark between the electrodes.

DESCRIPTION OF THE PREFERRED EMBODIMENT

Figure 1:
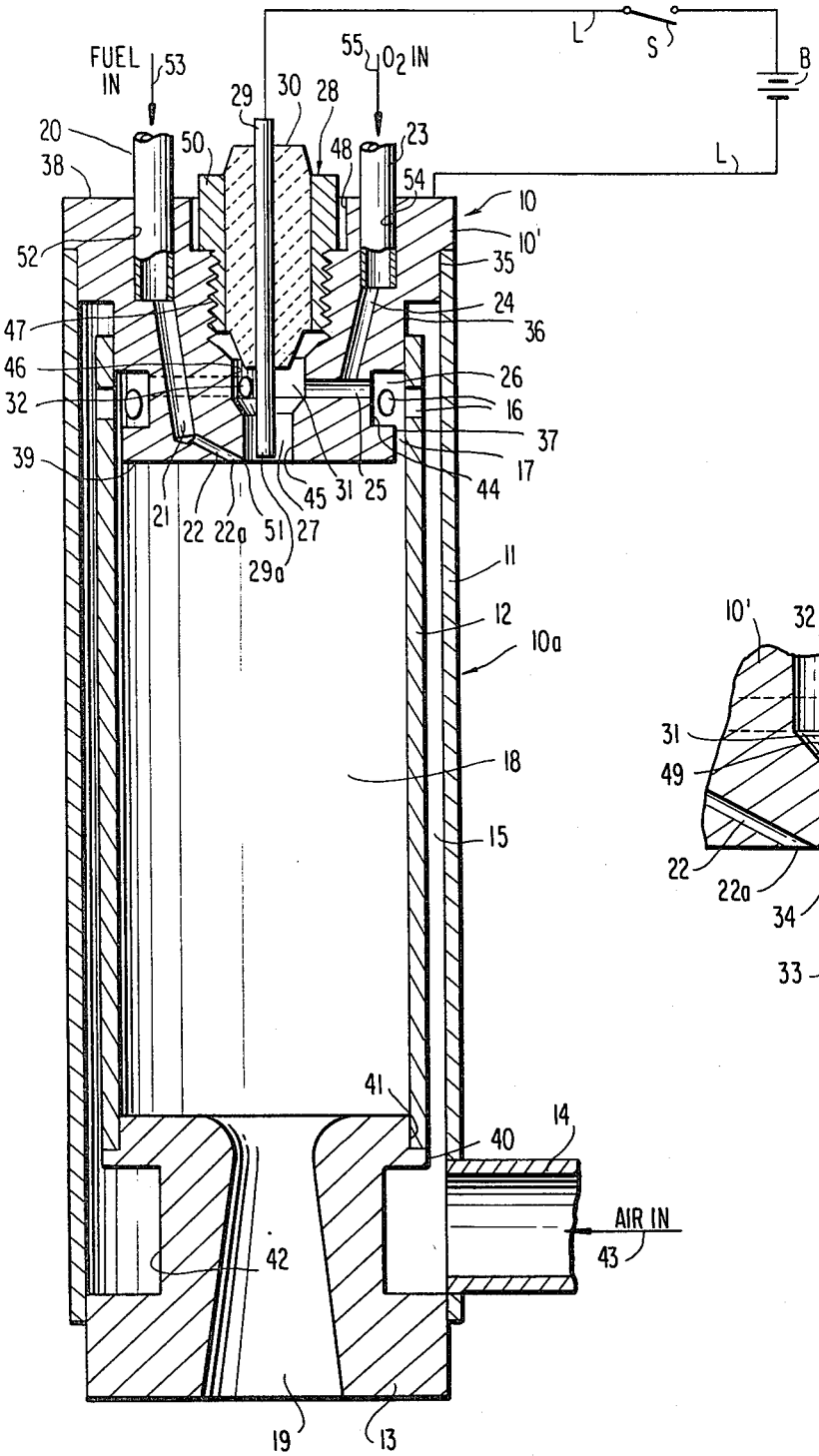
FIG. 1 is a longitudinal sectional view of an internal burner type ultra-high velocity flame jet apparatus including the improved ignition system of the present invention and forming a preferred embodiment thereof.

Referring to the drawings, the figures show an internal burner type ultra-high velocity flame jet apparatus indicated generally at 10 which has general application to the method and apparatus of the referred to U.S. Pat. No. 2,990,653 and is particularly useful in work drilling and high-energy metallizing. In that instance either an abrasive particle stream is ejected at high velocity through a nozzle bore 19 of nozzle piece 13 at one end of the apparatus, or alternatively the flame jet which emanates from the apparatus at this point bears high velocity metal or ceramic particles to be applied to a base or substrate positioned in front of the nozzle 13 and spaced some distance therefrom. The flame jet apparatus 10 consisting principally of the internal burner 10*a*, comprises a cylindrical metal injector piece 10' having a stepped outer periphery including a first annular peripherial recess 35, a second annular peripheral recess 36 and a third annular peripheral recess 37, from an upstream end wall or face 38 towards a downstream and face 39. End face 39 opens directly to a combustion chamber 18. At the opposite end of the burner 10*a*, the combustion chamber 18 is closed off by a cylindrical nozzle piece 13 which bears a first annular peripheral recess 40 and a second annular peripheral recess 41. The combustion chamber is cylindrical in form, the burner 10*a* being completed, other than by injector piece 10' and nozzle piece 13, by two concentric but spaced cylinders including an inner tube 12 having an internal diameter on the order of annular peripheral recess 36 of injector piece 10' and annular peripheral recess 41 within the nozzle piece 13 and being mounted at respective ends to these pieces. An outer tube 11 which is slightly longer in length has an internal diameter on the order of the first annular recess 35 within the injector piece 10' and on the order of the outside diameter of the nozzle piece 13 to which pieces it is fixed at opposite ends as by welding, etc., as is inner tube 12. An annular cooling space 15 is formed between the two tubes through which air under pressure is directed from the nozzle piece 13 towards the injector piece 10'. The nozzle piece 13 is provided with an annular groove 42 within its outer periphery closed off by outer tube 13 and functioning to distribute the compressed air which enters the annular space formed by groove 42 by way of a compressed air supply tube 14, the air, as indicated by arrow 43, entering the chamber for passage longitudinally within cooling space 15.

At the inlet side of the combustion chamber 18, the inner tube 12 is provided with a series of small diameter holes 16 which are circumferentially spaced about the tube and open to an annular distribution chamber or collector 26 defined by a further annular groove 44 within the periphery of injector piece 10, and specifically extending longitudinally within annular recess 37 over a limited extent of the same. The gap between annular recess 37 and the inner wall of the inner tube 12 defines an annular passage 17 which functions to feed the major portion of the compressed air, after cooling of the combustion chamber 18, into the combustion chamber for mixture with fuel to form a fuel/air mixture permitting and sustaining combustion within chamber 18. The injector piece 45 which closes off the inlet end of the combustion chamber 18 is provided with a bore 45, a first counterbore 46, a second threaded counterbore 47 and terminates in a third counterbore 48, adjacent face 38. A tapered wall portion 49 joins bore 45 to counterbore 46. Mounted within this portion of the injector piece 10' is a spark plug indicated generally at 28 which includes an outer cylindrical metal member 50 which threads to the threaded counterbore 47, locking the spark plug 28 to the injector piece 10'. The spark plug 28 further includes an axial, central electrode 29 in the form of a conductive rod which is mechanically supported and electrically insulated from cylindrical member 50 by means of a ceramic insulator 30.

In the illustrated embodiment, the ceramic insulator 30 terminates short of tip 29*a* of the first or central electrode 29, which tip projects through an annular passage defined by bore 45 and counterbore 46 within the injector piece 10', forming an annular chamber, 31 which narrows to annular space 27. The tip or terminal end 29*a* of the first and central electrode 29 is essentially flush with the face 39 of the injector piece 10', the bore 45 and face 39 defining a circular edge 51 of metal injector piece 10' which piece functions as the second electrode for the spark plug. When an electrical circuit is completed between the central electrode 29 and the injector piece 10' acting as the second electrode, a spark occurs radially across the annular gap or space 27 at edge 51 of the injector piece 10'.

As an improvement to the type of apparatus shown in my earlier U.S. Pat. No. 2,990,653, fuel is supplied to the burner 10*a* by means of a fuel supply tube 20 which terminates within a circular hole 52 within face 38 of the injector piece 10'. The fuel tube 20 opens to a slightly inclined smaller diameter fuel passage 21 which, in turn, feeds to a fine or small diameter, inclined fuel supply passage 22 opening at port 22*a* within the end face 39 of the injector piece 10' adjacent the circular edge 51, defining the second electrode for the burner 10*a*. Thus, a liquid fuel such as diesel oil is fed, under pressure as indicated by arrow 53, into the combustion chamber interior, at a region immediately in front of the termination point for bore 45 and the annular gap or space 27 between the first and second electrodes.

As a further important aspect of the present invention, an oxygen enriched gas such as pure oxygen under pressure is fed to the annular gap or space 27 by means of an oxygen supply tube 23 which projects within a circular hole 54 within the injector piece 10' from face 38 inwardly, which communicates with a smaller diameter passage 24 and which in turn opens to a radial passage 25. Radial passage 25 extends between the air collector or distribution chamber 26 and the chamber 31 defined by counterbore 46 and the first electrode 29. In this manner, during initial ignition, pure oxygen enriched gas (relative to the oxygen content of atmosphereic air) is forced under pressure to enter into the immediate vicinity of the spark gap and preferably in the vicinity where the liquid fuel enters the combustion chamber 18. Not only is a very rich fuel/air mixture achieved, but the oxygen flow under pressure functions to atomize the liquid fuel directly at the point where the ignition spark takes place. As a further important aspect of the present invention, it may be appreciated that while the majority of the compressed air flow, after cooling of the burner body, enters the combustion chamber 18, adjacent inner tube 12, some air passes to chamber 31 via passages 25 and 32 to continue the extended arc initially set by flow of enriched oxygen via tube 23. To effect ignition, schematically, a spark is effected across the electrode upon closure of switch S with a circuit including electrical source B.

As may be appreciated, the radial passage 25 opens at one end to counterbore 46 and chamber 31 adjacent the central first electrode 29. At its opposite end, it opens into the annular recess or groove 44 within annular recess 37 on periphery of the injector piece 10' and annular collector chamber 26 so that a portion of the pure oxygen or highly oxygen enriched gas enriches the main air flow stream entering the combustion chamber 18 via annular passage 17, adjacent the interior surface of the inner tube 12. The utilization of passage 25 which provides the division is of greater importance once ignition has occured than during initial ignition. When the main air flow and the flow of fuel, as by way of arrows 43 and 53, is increased more even combustion results due to the oxygen enrichment about the periphery of the combustion chamber at the upstream end of that chamber where the main air flow stream enters at the point where the annular passage 17 opens to the combustion chamber 18. Thus, a more even combustion results due to this oxygen enrichment. Further, this permits reliable turn up to full operational flow.

Figure 2:
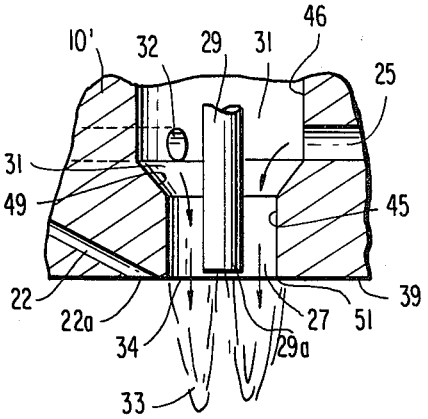
FIG. 2 is an enlarged, sectional view of a portion of the injector piece of the apparatus of FIG. 1 illustrating the nature of the improved extended spark ignition and atomization of the liquid fuel in the vicinity of the extended spark formed thereby.

The operation of the flame jet apparatus incorporating the improved ignition system and operational method of the present invention may be readily apparent from viewing FIGS. 1 and 2 and from the prior discussion. However, briefly, at the initial ignition by closing of switch S from electrical power source identified schematically by battery B, causes a spark to be experienced between points of different potential, i.e. electrode tip 29*a* and edge 51 of the injector piece 45 constituting the second electrode. Of course, this is a schematic representation but produces an arc which is elongated in the nature illustrated in FIG. 2 at 33. With fuel entering the combustion chamber 18 by way of the small diameter or fine fuel passage 22, and from port 22*a*, the fuel flows directly into the extended arc 33. Oxygen either in pure form or as an oxygen enriched gas, enters the oxygen supply tube 23 as indicated by arrow 55, continuing only during burner start up and passing from tube 23 through passage 24 to radial passage 25. Passage 25 divides the oxygen flow, causing it to move in two directions, radially towards the center and into counterbore 46, where it flows parallel to the axis of the concentric electrode through annular gap or space 27, that is, from chamber 31 through annular passage 27 to the combustion chamber 18. In addition, a small portion of the air flow which passes through annular cooling passage 15, does not enter the combustion chamber 18 via annular passage 17 between the peripheral recess 37 and the internal face of the inner tube 12, but passes from the annular collector 26 radially inwardly through radial passage 32 to the counterbore chamber 31 and exits into the combustion chamber along with the high oxygen content gas flow entering chamber 31 via radial passage 25. The air enforces the total flow through chamber 31 and the annular passage 27, as comprised of a high percentage of oxygen during initial ignition and burner start up. Subsequent to ignition and burner start up, the flow of oxygen under pressure to tube 23 terminates by means (not shown) and with the oxygen shut off, the only flow through the annular passage 27 between first electrode 29 and the second electrode 51 comprises compressed air. However, at all times, there is a certain amount of gas flow which intersects fuel entering the chamber obliquely or diagonally from hole 22 to atomize and project the atomized fuel into the flame region downstream of face 29 and axially of the combustion chamber 18.

Preferably, in the sequence of burner start up, the flow of air to air inlet tube or pipe 14 is maintained relatively small. Further, when this flow is initiated, the oxygen flow within tube 23 is initiated, switch S is closed, and a spark is initiated between the tip or end 29*a* of the first central electrode 29 and the second electrode as evidenced by circular edge 51 of bore 45 of the injector piece 10'. When fuel flow is initiated within tube 20 (by means not shown), and ignition is effected, the fuel/air mixture ignites in the oxygen rich zone just beyond bore 27, FIG. 2. When ignition is effected, the air and fuel flows are increased to their desired operating values and the oxygen supply to tube 23 is turned off. The power to the spark plug electrodes may be turned off as soon as ignition occurs. While schematically the electric source is indicated as a battery, it is in fact either a high voltage transformer or a capacitor discharge device of conventional design. The circuit is completed by leads L which are, as indicated, attached to the top end of the electrode 29 and to any of the conducting elements communicating with injector piece 10'.

In theory, the initial spark jumps the shortest path directly from the circular forward edge of electrode 29 to the circular edge of bore 45 defining annular passage 27. The air or oxygen heated by this electric flow is swept into the combustion chamber 18. The spark action continues but follows the path of least electrical resistance, i.e., the hot gases form a "flame" of sparking gases projecting one-half inch or more beyond the end of the electrode 29, FIG. 2. As may be appreciated, the fuel which is being atomized as it enters the chamber, passes directly into the intensely heated region to be ignited in a nearly pure oxygen flow path.

Although a starting air flow is not a requirement of the ignition porcess, it is desirable to prevent unwanted back flashes into the annular passage 15, thus preferably air flow is first initiated as per arrow 43 within air supply tube 14. Further, it increases the degree of liquid fuel atomization which is a desirable end in itself.

Although the illustrated embodiment of the invention has been described as employing the improved ignition system in conjunction with a compressed air internal burner type of flame jet apparatus, the principles of the invention are equally applicable to an internal burner using pure oxygen or oxygen enriched air as the oxidizer rather than compressed air supplied by way of tube 14 to the apparatus. In the case of pure oxygen, the oxygen flow is used to atomize the fuel during normal combustion, with oxygen supplied both by way of tube 14 and tube 23 during continued operation of the apparatus subsequent to initial ignition and burner start up.

While the invention has been particularly shown and described with reference to a preferred embodiment thereof, it will be understood by those skilled in the art that various changes in form and details may be made therein without departing from the spirit and scope of the invention.

What is claimed is:

1. In a method of spark-igniting operating reactants in an internal burner type ultra-high velocity flame jet apparatus by causing a confined and selectively continuous stream of combustible fluid media formed of compressed natural air, oxygen-enriched air, or oxygen and a fuel constituting said reactants, to pass through an elongated cylindrical combustion chamber within said internal burner for discharge at the downstream end thereof through a flow constricting nozzle to the atmosphere and by effecting an electrical spark between a first electrode separated by a narrow annular space from a second concentric electrode and extending the length of the spark by passing a flow of natural air under pressure through the annular space, the improvement comprising the steps of:

effecting, at least during initial ignition and burner start up, an additional flow of gas having an enriched oxygen content greater than that of natural air through said narrow annular space, and supplying said fuel in liquid form to the combustion chamber by discharging said liquid fuel into said enriched oxygen gas flow as it exits from said narrow annular space into the combustion chamber for atomizing said liquid fuel and for creating a highly enriched atomized fuel/oxygen mixture in the area of said extended length spark.

2. The method as claimed in claim 1, further comprising the step of dividing said flow of gas having an oxygen content greater than that of natural air into two portions and passing a first portion through said narrow annular space and adding a second portion thereof to the main flow of compressed air entering the combustion chamber at an area remote from said annular space between said electrodes, but at the upstream end of the combustion chamber.

3. In an internal burner type ultra-high velocity flame jet apparatus comprising:

cylindrical tube means, a nozzle piece closing off one end of said cylindrical tube means, and an injector piece closing off the other end of said cylindrical tube means, said cylindrical tube means, said nozzle piece and said injector piece defining an elongated combustion chamber, means for supplying compressed air to said combustion chamber, means for supplying fuel to said combustion chamber for mixing with said compressed air to form operating combustion reactants, spark plug means carried by said internal burner and means for creating an electrical spark between electrode means of said spark plug for effecting ignition of a combustible media formed by said operating reactants, the improvement wherein:

said spark plug means comprises a spark plug including a central first electrode borne by said injector piece, axially aligned with said nozzle piece and insulated from said injector piece and carried by said injector piece coaxial with said nozzle piece at the opposite end of said combustion chamber from said nozzle piece, said conductive injector piece including a portion surrounding said first electrode and forming a second electrode and being spaced therefrom to define an annular space, said injector piece including an annular compressed air distribution chamber and having longitudinal gap means opening from said air distribution chamber to the combustion chamber interior along the inside periphery of said tube means, means for supplying compressed natural air to said annular distribution chamber, at least one radial passage standing between said annular space surrounding said central electrode and said annular distribution chamber for supplying compressed natural air to said annular space surrounding said central electrode, a fuel supply passage within said injector piece opening to said combustion chamber adjacent said annular space between said first and second electrodes and, means for supplying a gas having an oxygen content greater than that of said compressed natural air to said annular space during ignition and burner start up for atomization of liquid fuel entering said combustion chamber via said fuel supply passage, whereby: said gas having an oxygen content in excess of that of natural air causes atomization of the liquid fuel entering said chamber in the vicinity of the electrodes and an extended spark between said electrodes axially of said combustion chamber and remote from the inner periphery of said tube means where the majority of the compressed natural air enters said combustion chamber to mix with the fuel and to form the operating reactants therefor.

4. The apparatus as claimed in claim 3, wherein said means for supplying a gas having an oxygen content greater than that of said compressed natural air comprises an oxygen supply tube mounted to said injector piece and opening to an oxygen supply passage leading from said oxygen supply pipe to said at least one radial passage communicating said annular distribution chamber with said annular space between said first and second electrodes; such that said gas having an oxygen content greater than that of natural air is split with some of said oxygen enriched gas passing to said annular space between said electrodes and some of said oxygen enriched gas passing into said annular chamber for mixture with said compressed air prior to said compressed air entering the combustion chamber about the interior periphery of said tube means.

* * * * *